United States Patent [19]

Jatczak

[11] 4,154,320

[45] May 15, 1979

[54] LIFE RESCUE EVACUATION UNIT

[76] Inventor: Ellen K. Jatczak, 5105 Blue Ridge Ave., Annandale, Va. 22003

[21] Appl. No.: 837,873

[22] Filed: Sep. 29, 1977

[51] Int. Cl.[2] ..... A62B 1/20

[52] U.S. Cl. ..... 182/48; 182/50

[58] Field of Search ..... 182/48, 49, 50, 70, 182/71, 72, 73, 74, 75

[56] References Cited

U.S. PATENT DOCUMENTS

| | | | |
|---|---|---|---|
| 276,090 | 4/1883 | Sperry | 182/50 |
| 395,455 | 1/1889 | Reiss et al. | 182/48 |
| 993,368 | 5/1911 | Hartmann | 182/74 |
| 2,997,125 | 8/1961 | Davis | 182/17 |

*Primary Examiner*—Reinaldo P. Machado
*Attorney, Agent, or Firm*—John Edward Roethel

[57] ABSTRACT

A life rescue evacuation unit is provided to effect recovery of persons or property imperiled by fires, earthquakes and other emergencies. One embodiment comprises a portable apparatus to be employed at a location remote from the danger. A rescue chute is projected over to the trapped people whereby they may slide to safety. Another embodiment provides for the rescue chute to be associated with the imperiled structure. The chute is projected to a safe, remote area to allow people to slide down the chute and out of danger.

4 Claims, 4 Drawing Figures

LIFE RESCUE EVACUATION UNIT

BACKGROUND OF THE INVENTION

There are many disaster situations which require quick deployment of rescue means to save imperiled people. However, most of the conventional rescue equipment is designed for single purpose application. Many old two or three story office buildings are equipped with fire escapes, but these are of little utility in the event of earthquakes. The construction of high-rise office or apartment buildings has brought to light the realization that present fire department equipment cannot reach the upper floors. Thus, a critical need exists for a device that can effectuate resuces of trapped persons from even the tallest buildings.

Furthermore, there are many other rescue situations in which a need for convenient lifesaving equipment exists. People get trapped or stranded while mountain climbing or in floods, for example. In this regard, the present invention has sufficient portability that a rescue team as small as one or two persons can transport the rescue unit to an appropriate location even so remote that conventional hook and ladder trucks could not be used.

In general, this invention relates to rescue devices of the type wherein a chute is disposed between an imperiled structure and a safe place of rescue remote therefrom. People trapped in the structure can escape by sliding down the chute. In like manner, property may also be saved by means of the chute.

The prior art is replete with constructions devised to effect rescues. U.S. Pat. No. 275,197 to Griffin (1883) discloses a cannon mounted on a horse-drawn carriage that shoots a guideline up to a burning building. By a complicated pulley arrangement, a rescue ladder with a chute is then hoisted up to a window to allow a rescue to take place. Likewise, U.S. Pat. No. 383,491 to Reimers (1888) shows a chute disposed from a window to allow trapped people to slide down.

U.S. Pat. No. 3,838,750 to Williams et al. (1974) discloses an amazingly complex rescue device that is fixedly mounted on a building beneath a window. Upon actuation, a pad pivots to the ground carrying therewith a chute down which people can slide to safety. Finally, U.S. Pat. No. 3,994,366 to Okuma et al. (1976) shows a complicated rescue chute that cooperates with a lifeboat for ship accidents.

BRIEF SUMMARY OF THE INVENTION

The present invention realizes a practical alternative to the impractical devices exemplified by the above-described prior art. In general, the instant rescue device permits rapid deployment of the rescue unit so critical to minimizing loss of lives during fire, earthquakes or other disasters. Such prior art disadvantages as complicated pulley or lever arrangements are eliminated.

One embodiment comprises a device for deployment at a location remote from the point of danger. The apparatus basically is a rescue unit which includes a storage area for the rescue chute and means for projecting the chute to the site from which the people are to be rescued. Other elements include means to tension the chute after it is deployed, a padded platform to soften the landing after the slide down the chute, and wheels to make the apparatus more portable. Finally, means are provided to stabilize the apparatus to prevent its tipping during use.

Another embodiment is designed for use in an imperiled structure. The rescue chute and projecting means are combined in a single device that can be mounted on the outside of the structure from which people need to be rescued. The projecting means sends the chute down to a point of safety. The projecting means can be either manually operated or automatically triggered in response to a sensing means. The entire device can be permanently mounted just outside an egress point in a structure, e.g., just below a window ledge. Alternatively, the device may be portable, stored at various locations, and in the event of a disaster installed at the egress point and then deployed.

It is an object of the present invention to provide a rescue device that is easily deployable, inexpensive, and uncomplicated.

Another object is a rescue device that has a minimum of elements that are subject to malfunction.

Another object is a rescue device that can be used in a multitude of disaster situations and thus not limited to merely fire rescue situations.

Other features and advantages of the invention will be apparent during the course of the following description.

DETAILED DESCRIPTION OF THE INVENTION

Figure 1:
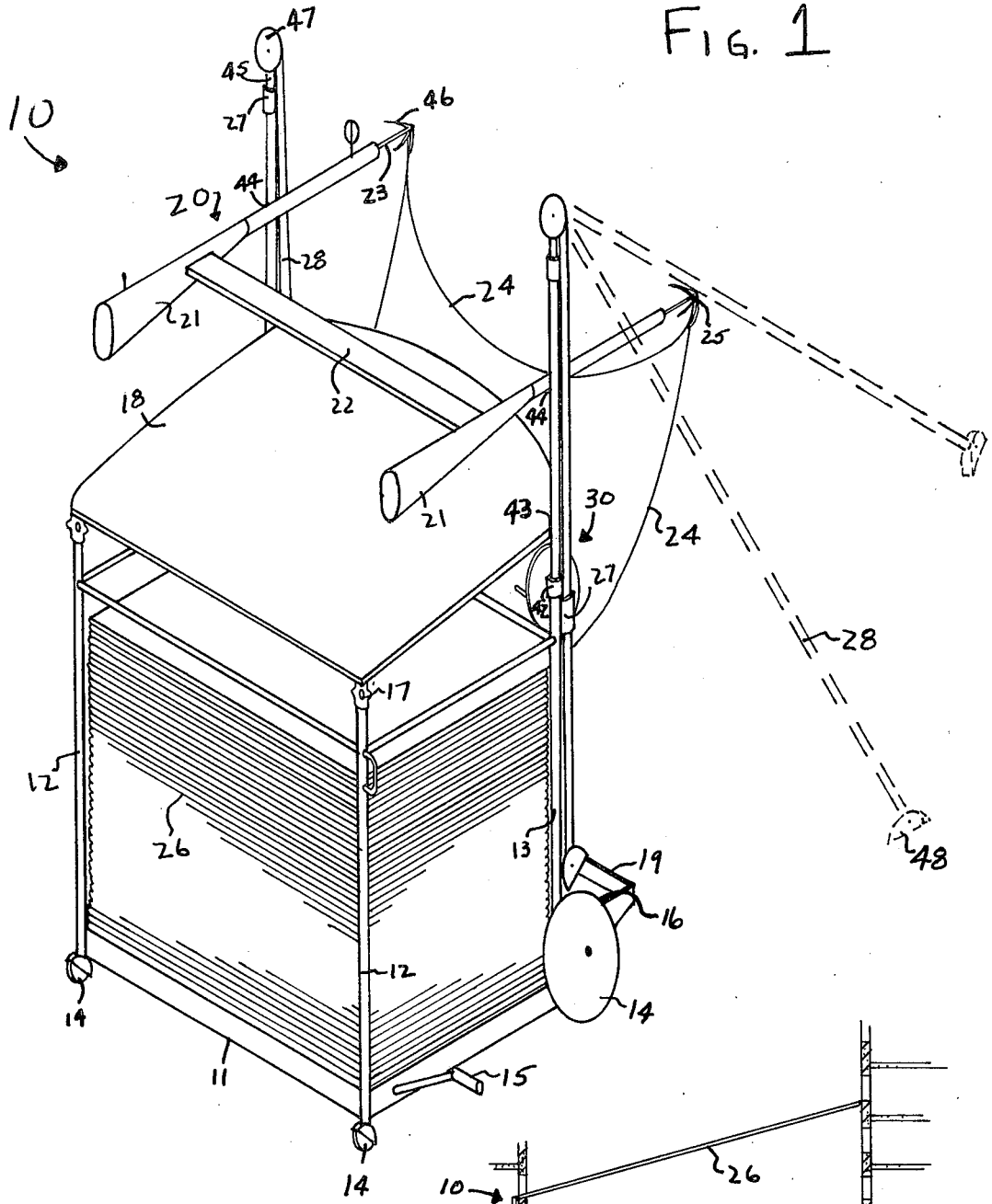
FIG. 1 shows the portable rescue unit of the present invention.

The portable rescue unit 10 of FIG. 1 is designed for maximum mobility and for deployment in a variety of situations. The lower part of the unit has a base 11 which contains the rescue chute 26 stored in an accordian fold. Extending up from the base are two rear upright tubes 12 which at their top ends support the rear edge of the padded platform 18. Telescoping connections 17 are provided to permit adjustment of the angle of the padded platform. On the front side of the base 11, a bumper 19 is provided as is a harpoon tray 16 to carry extra harpoons. Wheels 14 are mounted at appropriate locations to improve the mobility of the unit and a kickstand 15 extends under the base 11 to lift the back wheels off the ground when the unit is in use.

Forward upright tubes 13 extend up from the front side of the base 11. A pair of guns 21 are provided with a cross beam support 22 therebetween. Each gun 21 is respectively mounted on an upright 13 by way of a socket connection (not shown) at location 44 which permits both adjustment of the angle of the guns 21 and also removal of the entire projecting device 20 from between the upright tubes 13. Each gun 21 is provided with a harpoon 23 which in turn has a guidewire 24 connected to the harpoon 23 by means of a release pin connection 25. The release pin connection 25 permits the guidewire to be disconnected from the harpoon 23 at the end of the recovery operation. Each guidewire 24 assoicates with one side of the rescue chute 26.

Toward the upper end of each upright tube 13 there is a connecting bracket 27 which receives therein, in a telescoping manner, an extension tube 45. At the end of the extension tube 45 is a self-locking assembly 47 of a conventional type well-known in the art. Each self-locking assembly has connected thereto a bracing support 28 which is pivotable and/or rotatable about the top of upright tube 13 by means of self-locking assembly 47. The bracing support 28 comprises two telescoping parts associated through another connecting bracket 27 and a foot member 48 at the remote end of the bracing support 28.

Figure 2:
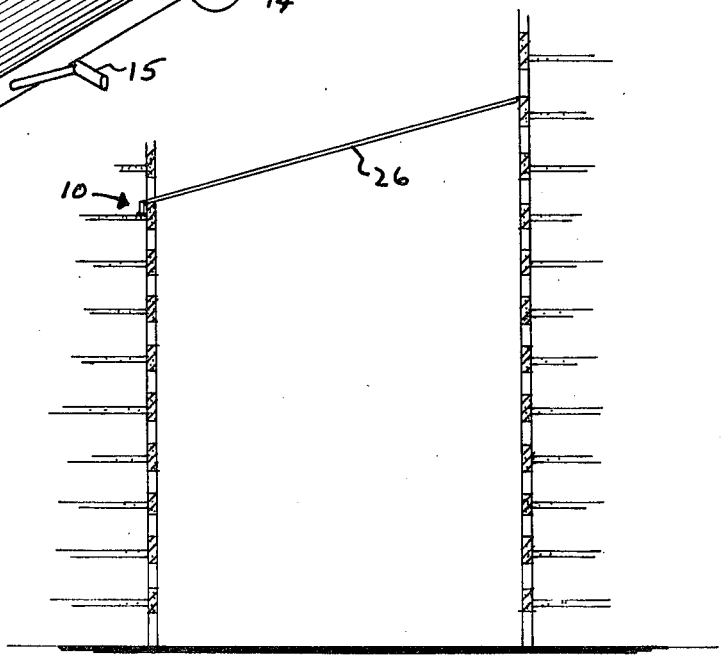
FIG. 2 shows an exemplary view of the rescue unit of FIG. 1 in use.

In operation, the portable rescue device 10 is carried or wheeled by the rescue workers to the location from which a rescue will be performed. For example, FIG. 2 shows the rescue unit 10 deployed adjacent a window in a building across from a building in which people are trapped by a fire. The rescue unit 10 is positioned next to a window with bumper 19 touching the wall below the window. Each bracing support 28 is pivoted up and/or rotated about by hand and locked in a position such that the rescue unit 10 is braced against that part of the wall area of the building adjacent the window. The kickstand 15 is deployed to lift the back wheels 14 off the floor to prevent the rescue unit 10 from rolling around during use.

After the unit 10 is appropriately positioned adjacent the window, the projecting device 20 is readied. The guns 21 are adjusted in their socket connections 44 at the proper angle to deliver the rescue chute 26 across to the imperiled building. A suitable device, e.g. a simple conventional electronic or mechanical system (not shown), is provided to insure that the guns are fired simultaneously. The firing of the guns 21 causes the harpoons 23 to be projected across to the imperiled building. Each harpoon 23 carries along with it a guidewire 24 which in turn causes the rescue chute 26 to unfold from its storage area. Each harpoon 23 has a grappling hook configuration 46 at its end to allow the harpoon 23 to be secured on a window ledge of the imperiled building. Thus, the actuation of the projecting device 20 results in the rescue chute 26 being disposed between the imperiled building and the location of safety, as shown in FIG. 2.

In order for the people or property trapped in the imperiled building to slide down the rescue chute to safety, it is necessary for the rescue chute 26 to be properly tensioned to substantially remove any slack therefrom. To effect such, a tensioning device 30 is employed.

Figure 3:
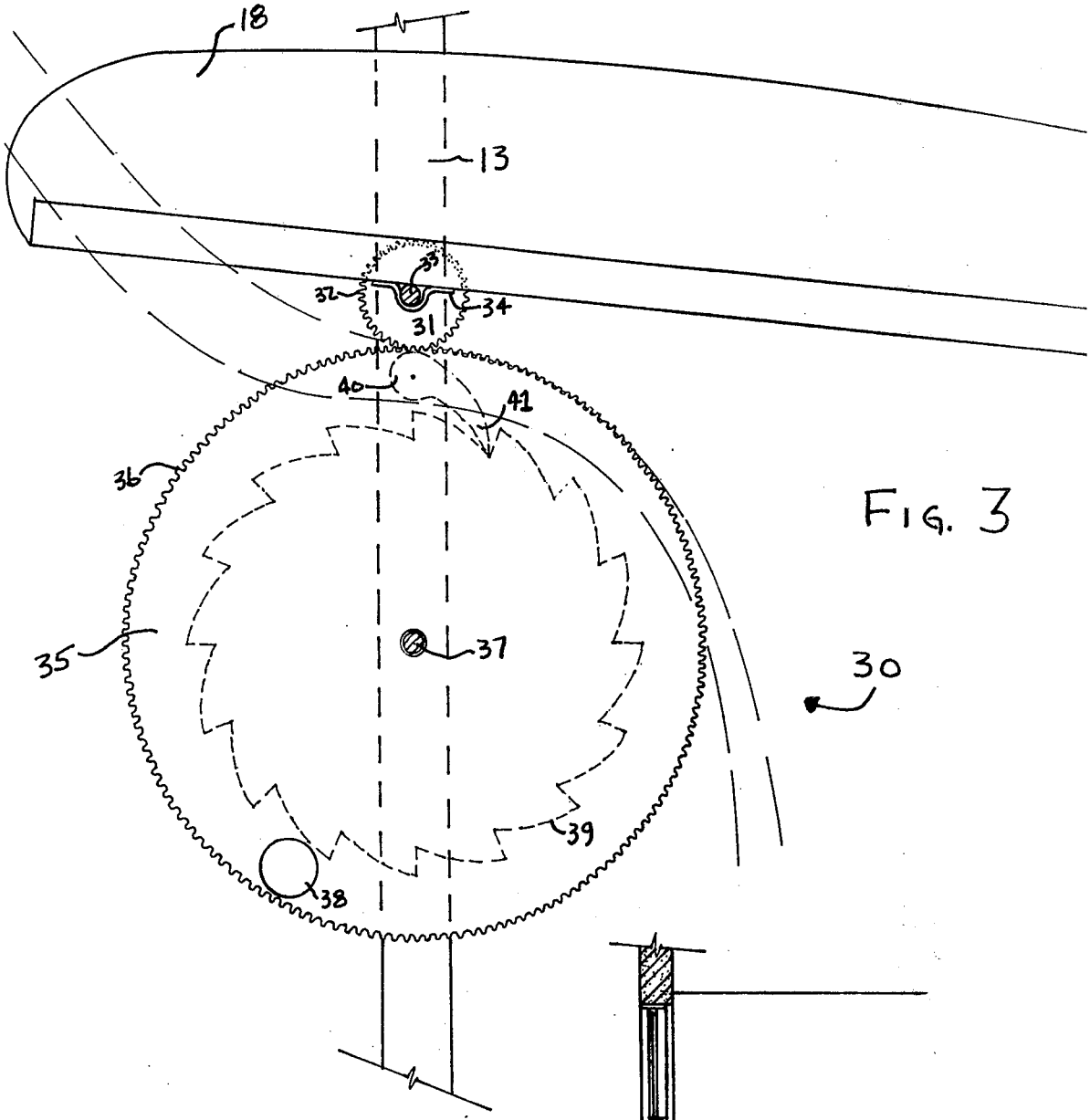
FIG. 3 is a side view of the tensioning device used on the unit of FIG. 1.

In FIG. 3, one of the two tensioning devices is shown, it being understood each forward upright tube 13 carries a tensioning device 30. A U-shaped bracket 34 is mounted on the bottom of the padded platform 18. The bracket 34 has set therein the axle 33 for the upper tensioning wheel 31. Just below this arrangement, lower tensioning wheel 35 is mounted on upright tube 13. An axle 37 extends across the front side of the rescue unit 20, through the two lower tensioning wheels 35, through each upright tube 13, and is secured by a fastener 42 (see FIG. 1). A handle 38 is provided on either one or both of the lower tensioning wheels 35.

The operation of the tensioning device 30 is as follows. After operation of the projecting device 20, the rescue chute 26 hangs suspended between the imperiled building and the rescue location. Each lateral side of the rescue chute 26 is then manually positioned between the upper tensioning wheel 31 and the lower tensioning wheel 35. This is easily accomplished since there is enough play between axle 33 and bracket 34 to permit a slight vertical movement of upper tensioning wheel 31 to allow insertion of the lateral edge of the rescue chute 26 between the tensioning wheels. However, after insertion, the weight of upper tensioning wheel 31 is sufficient to insure adequate cooperation between the two tensioning wheels to effect the tensioning.

After insertion of each lateral edge of the rescue chute 26 into the tensioning device 30, the handle 38 is engaged to turn lower tensioning wheels 35 to draw the rescue chute 26 taut. Since the two lower tensioning wheels 35 are joined by the common axle 37, they will rotate together. The tensioning is further enhanced by the provision of teeth 32 on each upper tensioning wheel 31 which cooperate with teeth 36 on each lower tensioning wheel 35 to thereby grip the rescue chute 26 between them and aid in pulling it taut. Backlash is prevented by providing each lower tensioning wheel 35 with a ratchet-type locking device comprising a plurality of sawteeth 39 which cooperate with a locking member 40 having a tongue 41 that wedges into the sawteeth 39.

During the actual rescue operation, the projecting device 20 can be removed from its mounting on the rescue unit 10 to permit an unobstructed path for people or property sliding down the chute.

Figure 4:
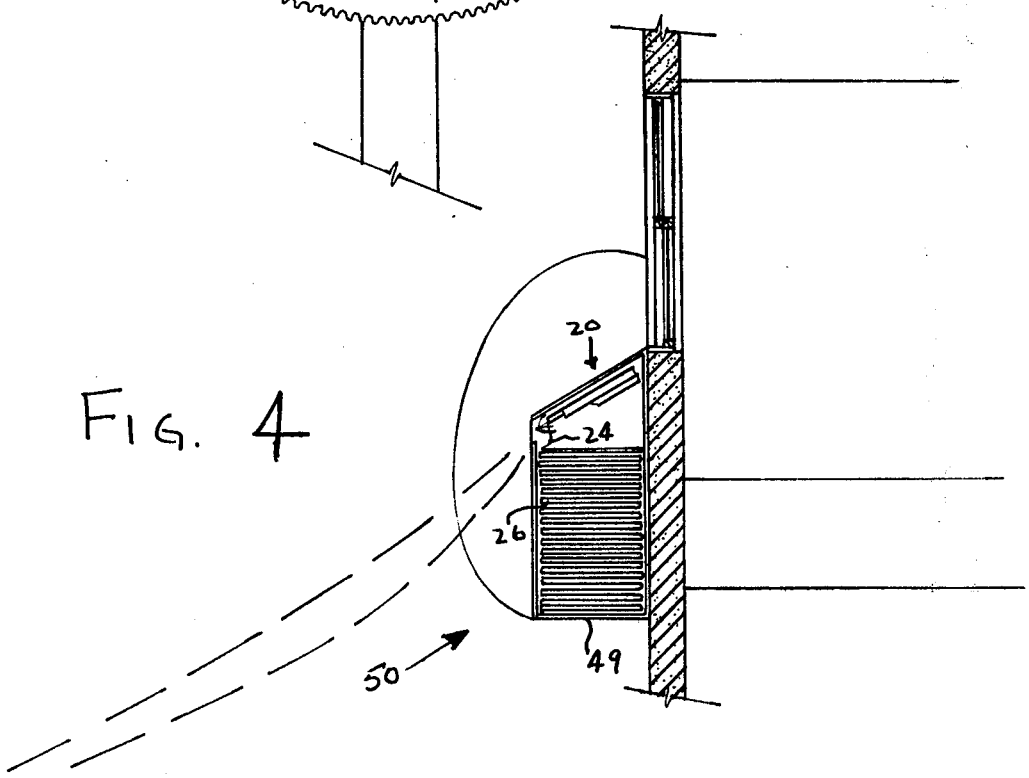
FIG. 4 shows an alternate embodiment where the rescue unit is mounted on the imperiled building.

FIG. 4 shows an alternate embodiment of the present invention wherein the rescue unit 50 is designed to be mounted on the imperiled building. A container 49 is provided that holds both the rescue chute 26 again stored in an accordian fold, and the projecting device 20 (similar to the projecting device shown in FIG. 1). Upon actuation of the projecting device 20, a pair of guidewires 24 are projected from the imperiled building down to a safety location, e.g. the ground or another adjacent building. Once the guidewires are secured at the safety location in any suitable manner, the rescue device is then ready for use. The rescue chute 26 can be designed so that the first person going down the chute carries the chute with him along the guidewires. Alternatively, the rescue chute can be extended simultaneously when the guidewires are originally projected.

The rescue device of this embodiment can either be permanently mounted at any suitable location in a building, e.g. beneath windows or under roof edges or balconies. It is also contemplated that the rescue device could be stored in convenient locations throughout the building and simply installed where needed in the event of an emergency.

Actuation of the projecting device can be done manually. However, it is within the scope of this invention to provide automatic deployment of the projecting device. For example, the building's fire alarm system could be wired into the projecting device or smoke detectors could be used to automatically trigger the projecting device. In the event of an earthquake, controls sensitive to earth tremors may be employed.

The rescue chute can be manufactured out of conventional high strength, lightweight synthetic materials. It should, of course, be fire resistant and capable of being folded into its accordion-like storage configuration.

It is contemplated that the rescue unit 10 shown in FIG. 1 could be deployed at locations other than in a building. The self-locking assembly 47 permits both pivoting and/or rotation of bracing support 28 to any desired orientation. Bracing support 28 comprises two parts telescoping through a connecting bracket 27 so that bracing support 28 may be extended to any desired length. Foot member 48 provides a secure mounting for bracing support 28. Thus, the rescue unit 10 can be firmly set up in any convenient location of safety such as an open area, between two trees, adjacent a wall, etc. The multiple orientability of the bracing supports 28 means that the rescue unit is not limited to use on flat ground, but can even be deployed in a sloping or irregular terrain.

It is intended that any variation of the invention readily apparent to those of ordinary skill in the art be contemplated herewith. Any equivalent tensioning device or projecting device may be employed. Furthermore, any suitable rescue chute configuration can be used.

What is claimed is:

1. A rescue device for effecting recovery of persons or property imperiled by fires, earthquakes or other emergencies comprising a rescue unit containing a rescue chute, means mounting on the rescue unit for projecting guidewires from the rescue unit to a location remote therefrom, the means for projecting comprising a pair of guns on a cross beam support adjustably mounted on the rescue unit to permit the angle at which the guidewires are projected to be varied, each gun being provided with a harpoon, each harpoon having a guidewire attached thereto by means of a release pin connection, whereby firing of the guns causes the harpoons carrying the guidewires therewith to be projected to the remote location, the rescue chute being extendible along the guidewires thereby providing a slide for effecting the recovery.

2. A rescue device for effecting recovery of persons or property imperiled by fires, earthquakes or other emergencies comprising a rescue unit containing a rescue chute, the rescue unit comprising a base including a storage space for the rescue chute and a platform located on the rescue unit above the storage space, said platform providing a landing area when the rescue chute is extended, means mounted on the rescue unit for projecting guidewires from the rescue unit to a location remote therefrom, the rescue chute being extendible along the guidewires thereby providing a slide for effecting the recovery.

3. A rescue device for effecting the recovery of persons or property imperiled by fires, earthquakes or other emergencies comprising a rescue unit containing a rescue chute, means mounted on the rescue unit for projecting guidewires from the rescue unit to a location remote therefrom, the rescue chute being extendible along the guidewires thereby providing a slide for effecting the recovery, tensioning means for pulling the rescue chute taut after the rescue chute has been extended, the tensioning means including, an upper tensioning wheel and a lower tensioning wheel mounted on the rescue unit, both the upper tensioning wheel and the lower tensioning wheel being provided with teeth to grip the rescue chute, and a locking member associated with the lower tensioning wheel, whereby the upper tensioning wheel and the lower tensioning wheel cooperate to pull the rescue chute taut and the locking member operates to prevent slippage in the tautness of the rescue chute.

4. A rescue device for effecting recovery of persons or property imperiled by fires, earthquakes or other emergencies comprising a rescue unit containing a rescue chute, means mounted on the rescue unit for projecting guidewires from the rescue unit to a location remote therefrom, the rescue chute being extendible along the guidewires thereby providing a slide for effecting the recovery, bracing supports mounted on the rescue unit, each bracing support cooperating with a self-locking assembly and a foot member, whereby the rescue unit, when in use, can be braced against any suitable support configuration and thereby be stabilized.

* * * * *